US011488552B2

(12) United States Patent
Ryu et al.

(10) Patent No.: US 11,488,552 B2
(45) Date of Patent: Nov. 1, 2022

(54) DISPLAY DEVICE AND METHOD FOR CONTROLLING SAME

(71) Applicant: SAMSUNG ELECTRONICS CO., LTD., Suwon-si (KR)

(72) Inventors: Hyunjeong Ryu, Suwon-si (KR); Jungmin Ku, Suwon-si (KR); Sunghwan Jang, Suwon-si (KR); Hwarang Pi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/262,581

(22) PCT Filed: Aug. 14, 2019

(86) PCT No.: PCT/KR2019/010346

§ 371 (c)(1),
(2) Date: Jan. 22, 2021

(87) PCT Pub. No.: WO2020/067644

PCT Pub. Date: Apr. 2, 2020

(65) Prior Publication Data

US 2021/0233481 A1 Jul. 29, 2021

(30) Foreign Application Priority Data

Sep. 27, 2018 (KR) ..... 10-2018-0114716

(51) Int. Cl.
*G09G 3/36* (2006.01)

(52) U.S. Cl.
CPC ..... *G09G 3/3607* (2013.01); *G09G 2310/027* (2013.01); *G09G 2310/08* (2013.01)

(58) Field of Classification Search
CPC .. G09G 3/3607; G09G 3/20; G09G 2310/027; G09G 2310/08; G09G 2320/04;
(Continued)

(56) References Cited

U.S. PATENT DOCUMENTS 6,707,439 B2 3/2004 Ijima et al.
7,880,712 B2 2/2011 Lee
(Continued)

FOREIGN PATENT DOCUMENTS

JP 2008-262105 A 10/2008
JP 2017-049319 A 3/2017
(Continued)

OTHER PUBLICATIONS

International Search Report dated Nov. 26, 2019 issued by the International Searching Authority in counterpart International Application No. PCT/KR2019/010346 (PCT/ISA/210).
(Continued)

*Primary Examiner* — David Tung
(74) *Attorney, Agent, or Firm* — Sughrue Mion, PLLC

(57) ABSTRACT

A display device is disclosed. The display device comprises: a display panel; a memory storing information on a compensation value according to a change in gray scale of an input image, which is preconfigured according to a driving frequency of the display panel; a timing controller for controlling the display panel to display a current frame of the input image, on the basis of information stored in the memory; and a processor for acquiring a target gray scale value of the current frame on the basis of a frequency of the current frame, acquiring a compensation value corresponding to the acquired target gray scale value, and controlling the timing controller to display the current frame on the basis of the acquired compensation value.

9 Claims, 6 Drawing Sheets

(58) Field of Classification Search
CPC ..... G09G 2320/043; G09G 2320/0693; G09G 2340/0435; G09G 5/18
See application file for complete search history.

(56) References Cited

U.S. PATENT DOCUMENTS

| | | | | |
|---|---|---|---|---|
| 8,456,397 | B2 | 6/2013 | Kim et al. | |
| 8,878,825 | B2 | 11/2014 | Kothari et al. | |
| 9,219,908 | B2 | 12/2015 | Kim | |
| 9,633,618 | B2 | 4/2017 | Kwak et al. | |
| 2004/0046727 | A1 | 3/2004 | Fujioka et al. | |
| 2006/0044242 | A1* | 3/2006 | Park | G09G 3/3648 345/89 |
| 2008/0084432 | A1* | 4/2008 | Jeon | G09G 3/3611 345/690 |
| 2008/0165106 | A1* | 7/2008 | Park | G09G 3/2022 345/89 |
| 2010/0020112 | A1* | 1/2010 | Jeon | G09G 3/3648 345/204 |
| 2013/0094754 | A1* | 4/2013 | Lee | G09G 5/003 382/167 |
| 2013/0155129 | A1* | 6/2013 | Park | G09G 3/3611 345/699 |
| 2014/0198093 | A1 | 7/2014 | Nambi et al. | |
| 2016/0035260 | A1* | 2/2016 | Kim | G09G 3/3614 345/212 |
| 2016/0189684 | A1* | 6/2016 | Ko | G09G 5/006 345/99 |
| 2018/0190214 | A1 | 7/2018 | Kim et al. | |
| 2018/0254010 | A1 | 9/2018 | Kitada et al. | |

FOREIGN PATENT DOCUMENTS

| | | | |
|---|---|---|---|
| KR | 10-2007-0072489 | A | 7/2007 |
| KR | 10-2009-0099668 | A | 9/2009 |
| KR | 10-2010-0037892 | A | 4/2010 |
| KR | 10-2012-0019728 | A | 3/2012 |
| KR | 10-1264689 | B1 | 5/2013 |
| KR | 10-1463035 | B1 | 11/2014 |
| KR | 10-2014-0136780 | A | 12/2014 |
| KR | 10-1774127 | B1 | 9/2017 |
| KR | 10-2018-0078713 | A | 7/2018 |

OTHER PUBLICATIONS

International Written Opinion dated Nov. 26, 2019 issued by the International Searching Authority in counterpart International Application No. PCT/KR2019/010346 (PCT/ISA/237).
Communication dated Sep. 19, 2019 issued by the Korean Intellectual Property Office in counterpart Korean Application No. 10-2018-0114716.
Communication dated Feb. 27, 2020 issued by the Korean Intellectual Property Office in counterpart Korean Application No. 10-2018-0114716.

* cited by examiner

FIG. 2

(n)th Frame

| (n-1)th Frame | 0 | 16 | 32 | 48 | 64 | 80 | 96 | 112 | 125 | 144 | 160 | 176 | 192 | 208 | 224 | 240 | 256 |
|---|---|---|---|---|---|---|---|---|---|---|---|---|---|---|---|---|---|
| 16 | - | | | | | | | | | | | | | | | | |
| 32 | | - | | | | | | | | | | | | | | | |
| 48 | | | - | | | | | | | | | | | | | | |
| 64 | | | | - | | | | | | | | | | | | | |
| 80 | | | | | - | | | | | | | | | | | | |
| 96 | | | | | | - | | 30 | | | 39 | | | | | | |
| 112 | | | | | | | - | | | | | | | | | | |
| 125 | | | | | | | | - | | | | | | | | | |
| 144 | | | | | | | | | - | | | | | | | | |
| 160 | | | | | | | | | | - | | | | | | | |
| 176 | | | | | | | | | | | - | | | | | | |
| 192 | | | | | | | | | | | | - | | | | | |
| 208 | | | | | | | | | | | | | - | | | | |
| 224 | | | | | | | | | | | | | | - | | | |
| 240 | | | | | | | | | | | | | | | - | | |
| 256 | | | | | | | | | | | | | | | | | - |

DISPLAY DEVICE AND METHOD FOR CONTROLLING SAME

TECHNICAL FIELD

The disclosure relates to a display device and a method for controlling the same, and more particularly, a display device for compensating a gray scale of an input image according to a change of a frequency of the input image and a method for controlling the same.

BACKGROUND ART

In recent years, images having a variable scan rate (or frequency) such as a variable scan rate (VRR) have appeared along with development of broadcasting and image technologies.

In this case, in order for a display panel having one driving frequency to display the input image having a variable scan rate, the display device should tune the input image by considering the driving frequency of the display panel.

If the driving frequency of the display panel is 120 Hz, the display device may tune frames of an input image having a scan rate different from the driving frequency so that the input image is implemented on the display panel at 120 Hz.

If the tuning as descried above is not performed with respect to frames of an input image having a scan rate different from the driving frequency, image quality deterioration (e.g., character drag, motion blur, and the like) of the input image may occur.

However, in the display panel having a specific driving frequency, the tuning may be performed with respect to an image frame within a certain range (if the driving frequency of the display panel is 120 Hz, the tuning may be performed with respect to an image frame at 100 to 120 Hz), and accordingly, the tuning is hardly performed with respect to all frames of the input image having variable scan rates.

DISCLOSURE

Technical Problem

The disclosure is made in view of the problem described above and an object thereof is to provide a display device for displaying an input image having a variable scan rate on a display panel having a driving frequency and a method for controlling the same.

Technical Solution

In accordance with an aspect of the disclosure, there is provided a display device including: a display panel; a memory configured to store information regarding a compensation value according to a change in gray scale of an input image preset according to a driving frequency of the display panel; a timing controller configured to control the display panel to display a current frame of the input image based on the information stored in the memory; and a processor configured to, based on the driving frequency of the display panel being different from a current frame frequency of the input image and a gray scale of the current frame of the input image being different from a gray scale of a previous frame of the input image, obtain a target gray scale value of the current frame based on the current frame frequency of the input image, obtain a compensation value corresponding to a gray scale value of the previous frame and the target gray scale value of the current frame among the compensation values according to a change in gray scale pre-stored in the memory, and control the timing controller to display the current frame based on the obtained compensation value.

The compensation value stored in the memory may include a dynamic capacitance compensation (DCC) value preset according to the driving frequency of the display panel.

The processor may be configured to obtain a compensation value corresponding to a relationship between a gray scale value of the previous frame and a gray scale value of the current frame among the compensation values pre-stored in the memory, and obtain a target gray scale value of the current frame by applying a predefined algorithm to the obtained compensation value for each frame frequency of the input image.

The processor may be configured to obtain a gray scale value of the current frame having a compensation value calculated by applying the predefined algorithm to the obtained compensation values, among a plurality of gray scale values of the current frame corresponding to the gray scale value of the previous frame pre-stored in the memory, as the target gray scale value of the current frame.

Based on the current frame frequency of the input image being higher than the driving frequency of the display panel, the target gray scale value of the current frame may be higher than the gray scale value of the current frame.

Based on the current frame frequency of the input image being lower than the driving frequency of the display panel, the target gray scale value of the current frame may be lower than the gray scale value of the current frame.

The processor may be configured to, based on the current frame frequency of the input image being the same as the driving frequency of the display panel and the gray scale of the current frame of the input image being different from the gray scale of the previous frame of the input image, obtain a compensation value corresponding to a relationship between a gray scale value of the previous frame and a gray scale value of the current frame among the compensation values pre-stored in the memory, and control the timing controller to display the input image based on the obtained compensation value.

The processor may be configured to compensate image data of the current frame based on the obtained compensation value, and control the timing controller to display the compensated image data on the display panel.

In accordance with another aspect of the disclosure, there is provided a method for controlling a display device including a display panel including a plurality of pixels, the method including: based on a driving frequency of the display panel being different from a current frame frequency of an input image input to the display panel and a gray scale of the current frame of the input image being different from a gray scale of a previous frame of the input image, obtaining a target gray scale value of the current frame based on the current frame frequency of the input image; obtaining a compensation value corresponding to a gray scale value of the previous frame and the target gray scale value of the current frame among pre-stored compensation values according to a change in gray scale; and displaying the current frame based on the obtained compensation value.

The pre-stored compensation value according to a change in gray scale may include a dynamic capacitance compensation (DCC) value preset according to the driving frequency of the display panel.

The obtaining the target gray scale value may include: obtaining a compensation value corresponding to a relationship between a gray scale value of the previous frame and a gray scale value of the current frame among the pre-stored compensation values according to a change in gray scale; and obtaining a target gray scale value of the current frame by applying a predefined algorithm to the obtained compensation value for each frame frequency of the input image.

The obtaining the target gray scale value may include: obtaining a gray scale value of the current frame having a compensation value calculated by applying the predefined algorithm to the obtained compensation value, among the pre-stored plurality of gray scale values of the current frame corresponding to the gray scale value of the previous frame, as the target gray scale value of the current frame.

Based on the current frame frequency of the input image being higher than the driving frequency of the display panel, the target gray scale value of the current frame may be higher than the gray scale value of the current frame.

Based on the current frame frequency of the input image being lower than the driving frequency of the display panel, the target gray scale value of the current frame may be lower than the gray scale value of the current frame.

The method may further include: based on the current frame frequency of the input image being the same as the driving frequency of the display panel and the gray scale of the current frame of the input image being different from the gray scale of the previous frame of the input image, obtaining a compensation value corresponding to a relationship between a gray scale value of the previous frame and a gray scale value of the current frame among the pre-stored compensation values; and displaying the input image based on the obtained compensation value.

The displaying the current frame may include: compensating image data of the current frame based on the obtained compensation value; and displaying the compensated image data on the display panel.

Effect of Invention

According to the aspects described above, the display device may display a plurality of image frames having scan rates different from the driving frequency of the display panel without image quality deterioration.

DESCRIPTION OF DRAWINGS

FIG. 2 is a diagram illustrating a DCC table according to an embodiment;

BEST MODE

Detailed Description of Exemplary Embodiments

Figure 1:
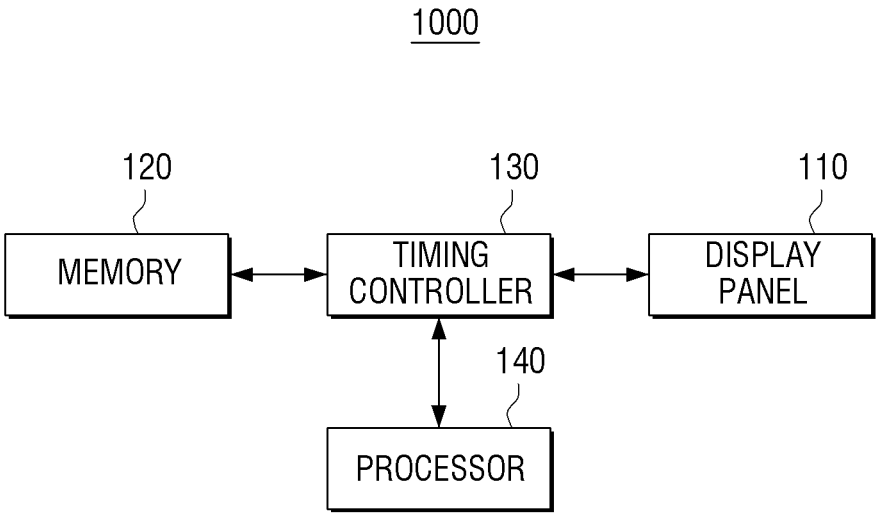
FIG. 1 is a block diagram illustrating a configuration of a display device according to an embodiment.

The disclosure will be described in greater detail below after briefly explaining the terms used in the disclosure.

The terms used in embodiments of the disclosure have been selected as widely used general terms as possible in consideration of functions in the disclosure, but these may vary in accordance with the intention of those skilled in the art, the precedent, the emergence of new technologies and the like. In addition, in a certain case, there may also be an arbitrarily selected term, in which case the meaning will be described in the description of the disclosure. Therefore, the terms used in the disclosure should be defined based on the meanings of the terms themselves and the contents throughout the disclosure, rather than the simple names of the terms.

The embodiments of the disclosure may be variously changed and include various embodiments, and specific embodiments will be shown in the drawings and described in detail in the description. However, it should be understood that this is not to limit the scope of the specific embodiments and all modifications, equivalents, and/or alternatives included in the disclosed spirit and technical scope are included. In describing the disclosure, a detailed description of the related art may be omitted when it is determined that the detailed description may unnecessarily obscure a gist of the disclosure.

The terms "first," "second," or the like may be used for describing various elements but the elements may not be limited by the terms. The terms are used only to distinguish one element from another.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

A term such as "module" or a "unit" in the disclosure may perform at least one function or operation, and may be implemented as hardware, software, or a combination of hardware and software. Further, except for when each of a plurality of "modules", "units", and the like needs to be realized in an individual hardware, the components may be integrated in at least one module and be implemented in at least one processor (not illustrated).

Hereinafter, with reference to the accompanying drawings, embodiments of the disclosure will be described in detail for those skilled in the art to easily practice the embodiments.

But, the disclosure may be implemented in various different forms and is not limited to the embodiments described herein. In addition, in the drawings, the parts not relating to the description are omitted for clearly describing the disclosure, and the same reference numerals are used for the same parts throughout the specification.

Hereinafter, various embodiments of the disclosure will be described in detail with reference to the drawings.

FIG. 1 is a block diagram illustrating a configuration of a display device according to an embodiment.

Referring to FIG. 1, a display 1000 may include a display panel 110, a memory 120, a timing controller 130, and a processor 140.

The display panel 110 may be implemented as a liquid crystal display panel. In this case, the display panel 110 may include a plurality of data lines $DL_1$ to $DL_m$, a plurality of gate lines $GL_1$ to $GL_n$, and a plurality of pixels formed at points where the plurality of data lines $DL_1$ to $DL_m$ intersect with the plurality of gate lines $GL_1$ to $GL_n$ Each pixel may include a liquid crystal (or liquid crystal cell), a transistor (thin film transistor (TFT)), and a liquid crystal capacitor CLc and a storage capacitor Cst connected to the transistor.

In this case, a gate-on signal (or gate-on voltage) is applied to the transistor via the gate line, the transistor is turned on, then, a data voltage according to a change in gray scale of an image frame is applied via the data line, and the data voltage may be charged on the liquid crystal capacitor or the storage capacitor through the transistor.

Accordingly, liquid crystals move to be twisted according to a size of the charged voltage, and a transmittance of light emitted via a backlight (not illustrated) of the display device 1000 may be adjusted according to a degree thereof to display an image frame having a specific gray scale through the display panel 110.

Meanwhile, the gate-on signal may be applied to the transistor according to a driving frequency of the display panel 110. If the driving frequency of the display panel is 120 Hz, the gate-on signal may be applied to the gate line so that 120 image frames are displayed in one second. In other words, the gate-on signal may be applied to the transistor so that one image frame is displayed in 1/120 seconds. Herein, the driving frequency of the display panel 110 may indicate a value fixed as a preset value when manufacturing the display device 1000.

Meanwhile, since duration of one frame is preset according to the driving frequency of the display panel 110, cells included in the display panel should express the gray scale of one frame within the duration of the one frame. For this, over-driving or under-driving technologies may be used.

The over-driving technology may refer to a technology of, if a gray scale of a current image frame is higher than a gray scale of a previous image frame, expressing the gray scale of the current image frame by applying a voltage higher than a voltage corresponding to the gray scale of the current image frame, in order to increase a response speed of liquid crystals included in a cell. On the other hand, the under-driving technology may refer to a technology of, if a gray scale of a current image frame is lower than a gray scale of a previous image frame, expressing the gray scale of the current image frame by applying a voltage lower than a voltage corresponding to the gray scale of the current image frame, in order to increase a response speed of liquid crystals included in a cell. Such over-driving or under-driving technology is a well-known technology and therefore the detailed description will be omitted.

The memory 120 may store information regarding a preset compensation value according to a change in gray scale of the input image according to the driving frequency of the display panel.

Specifically, the memory 120 may store information regarding a compensation value of a current image frame according to a difference between a gray scale of the current image frame and a gray scale of a previous image frame having a preset frequency according to the driving frequency of the display panel. The preset frequency of the image frame may be the same as the driving frequency of the display panel.

In other words, the memory 120 may store information regarding the compensation value according to a change in gray scale of the input image having the same frequency as the driving frequency of the display panel.

The compensation value stored in the memory 120 may include a dynamic capacitance compensation (DCC) value preset according to the driving frequency of the display panel 110. The DCC value herein may indicate an over-driving or under-driving voltage value to be applied to the cell by considering the gray scale value of the current image frame with respect to the gray scale value of the previous image frame so that liquid crystals of the cell responds within a period of time corresponding to one image frame.

FIG. 2 is a diagram illustrating a DCC value stored in the memory according to an embodiment.

Referring to FIG. 2, the memory 120 may store DCC values present according to the driving frequency of the display panel 110 in a form of a lookup table.

The DCC lookup table stored in the memory 120 may be a general DCC lookup table used in a display device including a liquid crystal display panel and may be a lookup table storing a compensation value according to a change in gray scale of an image frame having the same frequency as a driving frequency of the display panel.

The DCC lookup table may match a voltage value to be applied to a cell in order to represent a gray scale value of a current image frame by considering gray scale values of the current image frame and the previous image frame. For this, in the DCC lookup table, each of leftmost rows may show a gray scale value of a previous frame ((n−1)th frame) and each of uppermost columns may show a gray scale value of a current frame (n-th frame).

In each cell corresponding to each row and column of the DCC lookup table, an over-driving (or under-driving) voltage value to be applied to cell of the display panel according to a difference between the gray scale of the previous frame and the gray scale of the current frame may be matched.

It is assumed that, if the gray scale value of the previous frame having a specific frequency is 96 and the gray scale value of the current frame having the same frequency is 125, the over-driving voltage "30 mV" is necessary, in order to display the gray scale value of the current frame. In this case, the DCC table may store "30 mV" in a cell corresponding to a row with the gray scale value of the previous frame of 96 and the column with the gray scale value of the current frame of 125.

Meanwhile, if the gray scale of the previous frame is the same as the gray scale of the current frame, the over-driving (or under-driving) voltage is not necessary, and accordingly, the voltage value may be not matched to the cell corresponding to the row showing the gray scale value of the previous frame and the column showing the gray scale value of the current frame. In the DCC table illustrated in FIG. 2, "-" is shown if the gray scale of the previous frame is the same as the gray scale of the current frame and the over-driving (or under-driving) voltage is not necessary.

Meanwhile, the form of the DCC table of FIG. 2 is merely an embodiment, and in some cases, the DCC table may store the gray scale value of the current frame compensated when the over-driving (or under-driving) voltage is applied to each cell of the display panel 110, instead of the over-driving (or under-driving) voltage to be applied to each cell of the display panel 110, in order to express the gray scale of the current image frame.

Meanwhile, the timing controller 130 may receive an input image signal and control a gate driver (not illustrated) and a data driver (not illustrated) of the display panel 110 to display the input image on the display panel 110.

The timing controller 130 may control the gate driver to apply the gate-on voltage sequentially to the gate line to turn on the transistor of a cell connected to the gate line to which the gate-on voltage is applied.

In addition, the timing controller 130 may control the data driver (not illustrated) to apply a data signal to cells, to which the gate-on signal is applied, among a plurality of cells of the display panel 110.

The timing controller 130 may control the display panel to display the input image based on information of a compensation value according to a change in gray scale of the input image stored in the memory 120.

Specifically, when the frequency of the current image frame is the same as the driving frequency of the display panel 110, the timing controller 130 may calculate an over-driving voltage for expressing the gray scale of the current image frame by using the DCC lookup table stored in the memory 120 and control the data driver (not illustrated) so that the calculated over-driving voltage is applied to the cell of the display panel 110.

Meanwhile, the timing controller 130 may receive an input image frame having a frequency different from the driving frequency of the display panel 110. In this case, the timing controller 130 may control the data driver (not illustrated) so that an over-driving (or under-driving) voltage corresponding to a compensation value obtained based on a frequency and a gray scale of the received current frame is applied to the cell of the display panel 110.

The processor 140 may control general operations of the display device 1000. In particular, the processor 140 may control the timing controller 130 to display the current frame according to the gray scale of the current frame.

If a current frame frequency of the input image is the same as the driving frequency of the display panel 110 and a gray scale of the current frame of the input image is different from a gray scale of the previous frame, the processor 140 may obtain a compensation value corresponding to a relationship between a gray scale value of the previous frame and a gray scale value of the current frame among compensation values pre-stored in the memory 120.

If the current frame frequency of the input image and the driving frequency of the display panel 110 are 60 Hz, the gray scale of the previous frame of the input image is 95, and the gray scale of the current frame is 125, the processor 140 may obtain a compensation value, 30 mV, corresponding to the relationship between the gray scale value of the previous frame and the gray scale value of the current frame by using the DCC lookup table illustrated in FIG. 2.

In addition, the processor 140 may control the timing controller 130 to display the input image based on the obtained compensation value. Specifically, the processor 140 may control the timing controller 130 to apply the over-driving voltage having a magnitude same as the obtained compensation value to the data driver (not illustrated).

Meanwhile, if the gray scale of the current frame of the input image is different from the gray scale of the previous frame of the input image and the driving frequency of the display panel 110 is different from the frame frequency of the input image, the processor 140 may obtain a target gray scale value of the current frame based on the frame frequency of the input image, in order to obtain a compensation value according to the frequency and the gray scale value of the current frame.

For this, the processor 140 may obtain a compensation value corresponding to the relationship between the gray scale value of the previous image frame and the gray scale value of the current image frame among the compensation values pre-stored in the memory 120.

If the frequency of the current display panel is 60 Hz, the frequency of the current image frame is 120 Hz, the gray scale of the previous image frame is 96, and the gray scale of the current image frame is 125, the processor 140 may obtain the compensation value, 30 mV, corresponding to the relationship between the gray scale value of the current image frame with respect to the gray scale value of the previous image frame, by using the DCC lookup table illustrated in FIG. 2.

The processor 140 may obtain the target gray scale value of the current frame by applying predefined algorithm for each frequency of the current frame of the input image to the obtained compensation value. The predefined algorithm for each frequency of the frame of the input image may represent a relationship between a compensation value according to the gray scale values of the previous and current frames and a compensation value stored in the memory 120 for each frame frequency of the input image.

If it is assumed that the memory 120 stores a compensation value regarding the image frame at 60 Hz, the algorithm may be predefined so as to obtain a compensation value according to the gray scale values of the previous and current frames of the image frame at 120 Hz by multiplying 1.3 by a compensation value regarding the image frame at 60 Hz.

Meanwhile, this is merely an embodiment, and although the algorithm is predefined for each frequency of the image frame, the algorithm may be predefined for each gray scale in one image frame frequency. In the above example, the algorithm may be predefined so as to calculate the compensation value of the image frame at 120 Hz by multiplying 0.9 by the compensation value regarding the image frame at 60 Hz, in a case of the gray scale of 96 or lower, and calculate the compensation value by multiplying 1.3 by the compensation value regarding the image frame at 60 Hz, in a case of the gray scale higher than 96.

The processor 140 may obtain a gray scale value of the current frame having a compensation value calculated by applying the predefined algorithm to the obtained compensation value, among a plurality of gray scale values of the current frame corresponding to the gray scale value of the previous frame pre-stored in the memory 120, as a target gray scale value of the current frame.

When using the DCC lookup table illustrated in FIG. 2, if the frequency of the current display panel is 60 Hz, the frequency of the current image frame is 120 Hz, the gray scale of the previous image frame is 96, and the gray scale of the current image frame is 125, the processor 140 may obtain a compensation value, 30 mV, according to the gray scale value of the previous frame and the gray scale value of the current frame. However, 30 mV herein is a compensation value based on the input image frame at 60 Hz, and accordingly, the processor 140 should reset the compensation value considering the frequency (120 Hz) of the current image frame. For this, the processor 140 may calculate the compensation value by applying the algorithm predefined so as to obtain the compensation value according to the gray scale values of the previous and current frames of the image frame at 120 Hz by multiplying 1.3 by the compensation value regarding the image frame at 60 Hz, and the compensation value calculated at that time may be 30 mV*1.3=39 mV. In addition, the processor 140 may obtain a gray scale value of the current frame having the compensation value of approximately 39 mV, that is, a gray scale value of 176, as the gray target scale value of the current frame, among the gray scale values of the plurality of current frames corresponding to the gray scale value of 96 of the previous frame.

After obtaining the target gray scale value, the processor 140 may obtain a compensation value corresponding to the gray scale value of the previous frame and the target gray scale value of the current frame among the compensation values according to a change in gray scale pre-stored in the memory 120. For this, the processor 140 may use information regarding the compensation value according to a change in gray scale of the input image stored in the memory 120, that is, the DCC lookup table.

In the above example, after obtaining the target gray scale value of 176 of the current frame, the processor 140 may obtain the compensation value, 39 mV, according to a change in gray scale from the gray scale value of 96 of the previous frame to the gray scale value of 176 of the current frame by using the DCC lookup table stored in the memory 120.

In addition, the processor 140 may control the timing controller to display the current frame based on the obtained compensation value. Specifically, the processor 140 may compensate the image data of the current frame based on the obtained compensation value and control the timing controller to display the compensated image data on the display panel.

Figure 3:
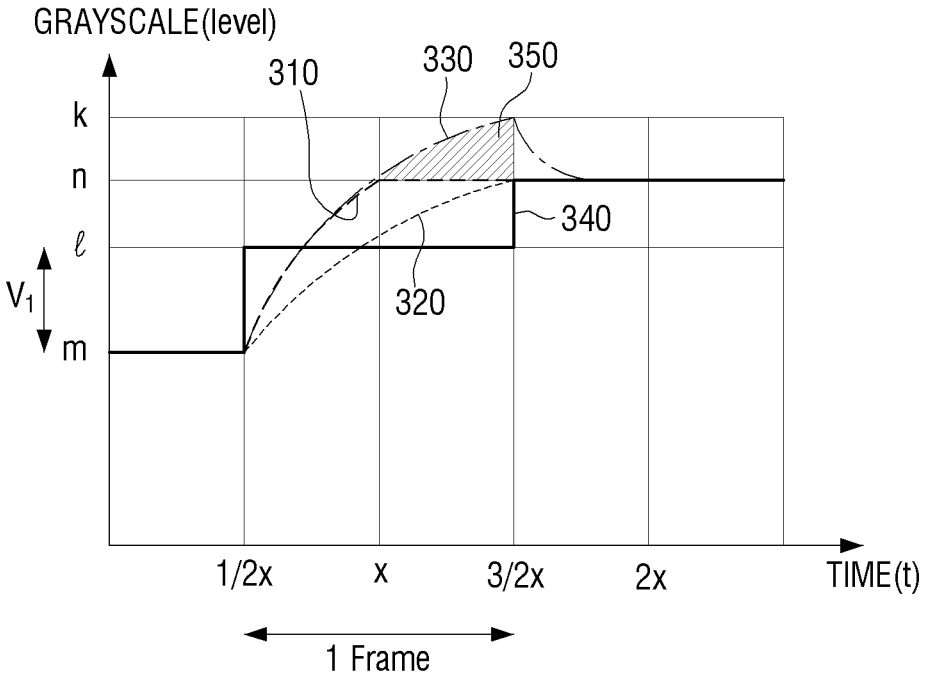
FIGS. 3 and 4 are diagrams illustrating an image display method of a display device according to an embodiment.
Figure 4:
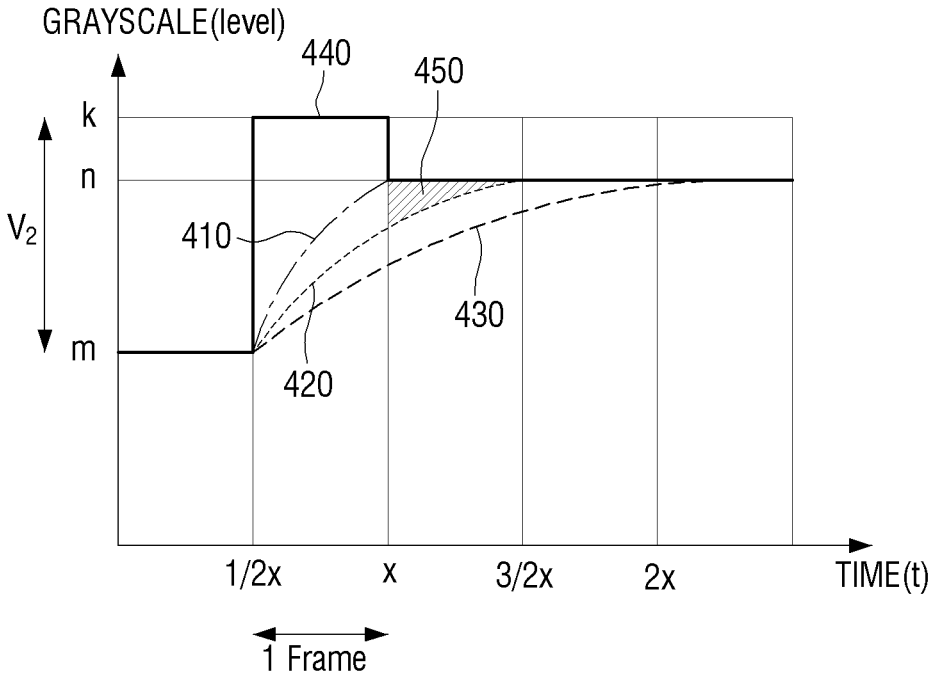

FIGS. 3 and 4 are diagrams illustrating an image display method of a display device according to an embodiment.

Specifically, FIG. 3 is a diagram illustrating an image display method of the display device, when the frequency of the current image frame is lower than the frequency of the display panel.

For convenience of description of FIG. 3, it is assumed that the gray scale of the previous image frame is m, the gray scale of the current image frame is n, the driving frequency of the display panel 110 is 2X Hz, and the frequency of the current image frame is X Hz.

In this case, since the driving frequency of the display panel 110 is 2X Hz, the memory 120 of the display device 1000 may store the compensation value regarding the gray scale of the previous frame and the gray scale of the current frame of the input image having the frequency of 2X Hz in a form of the DCC lookup table.

Meanwhile, since the frequency of the current image frame input to the display panel 110 is X Hz, a change in gray scale of the current image frame may be expressed as illustrated with a line 330 of FIG. 3, when the timing controller 130 displays the current image frame based on the compensation value according to a change in gray scale stored in the memory 120.

In other words, the compensation value stored in the memory 120 is applied during a period of time for displaying one image frame at X Hz, the compensation is performed up to a gray scale k that is higher than the gray scale n of the current frame, and this may lead to occurrence of an over-shooting phenomenon.

In order to prevent such a phenomenon, the processor 140 may calculate the target gray scale value of the current frame based on the current frame frequency of the input image.

The processor 140 may obtain the compensation value corresponding to the gray scale n of the current frame and the gray scale m of the previous frame by using the compensation value information according to a change in gray scale pre-sored in the memory 120, and obtain a target gray scale value 1 of the current frame by applying the predefined algorithm to the obtained compensation value according to the frequency of the current frame. The process for obtaining the target gray scale value has been described with reference to FIG. 1, and therefore the detailed description thereof will not be repeated for convenience.

Meanwhile, an amount of the gray scale compensated to obtain the target gray scale value at that time is the same as a difference $|k-n|$ between the gray scale n and the gray scale k of the current frame, and accordingly, the value 1 of the target gray scale may be the same as a value of $\{n-(|k-n|)\}$.

After obtaining the target gray scale value of the current frame, the processor 140 may obtain a compensation value corresponding to the gray scale value m of the previous frame and the target gray scale value 1 of the current frame among the compensation values according to a change in gray scale pre-stored in the memory 120, and the obtained compensation value may be the same as an over-driving voltage value $V_1$ to be applied to liquid crystals according to a change from the gray scale m to the gray scale 1. The over-driving voltage to be applied to the liquid crystals may be applied to the liquid crystals of the display panel 110 for a period of time corresponding to one frame of the current frame, as illustrated with a line 340 of FIG. 3.

As a result, the processor 140 may compensate the value of the gray scale n as the gray scale 1 in order to express the current frame having the gray scale of n, and control the timing controller 130 so that the timing controller 130 applies the over-driving voltage $V_1$ according to a change from the gray scale m of the previous frame to the compensated gray scale 1 of the current frame to a data driver (not illustrated) to display the current frame. At that time, the change in gray scale of the image frame displayed on the display panel 110 according to the application of the over-driving voltage $V_1$ to the data driver (not illustrated) by the timing controller 130 may be as illustrated with a line 320 of FIG. 3.

Meanwhile, FIG. 4 is a diagram illustrating an image display method of a display device, when the frequency of the current frame is higher than the frequency of the display panel.

For convenience of description of FIG. 4, it is assumed that the gray scale of the previous image frame is m, the gray scale of the current image frame is n, the driving frequency of the display panel 110 is X Hz, and the frequency of the current image frame is 2X Hz.

In this case, since the driving frequency of the display panel 110 is X Hz, the memory 120 of the display device 1000 may store the compensation value regarding the gray scale of the previous frame and the gray scale of the current frame of the input image having the frequency of X Hz in a form of the DCC lookup table.

Meanwhile, the frequency of the current image frame input to the display panel 110 is 2X Hz, and accordingly, when the timing controller 130 displays the current image frame based on the compensation value according to a change in gray scale stored in the memory 120, a change in gray scale of the current image frame may be expressed as illustrated with a line 420 of FIG. 4.

In other words, the compensation value regarding the image frame at X Hz stored in the memory 120 is applied during a period of time for displaying one image frame at 2X Hz, and this may lead to occurrence of an under-shooting phenomenon in that the current frame is displayed with a gray scale lower than the gray scale n of the current frame. In other words, the gray scale compensation may not be performed for an amount corresponding to a region 450 with diagonal lines of FIG. 4.

In or der to prevent such a phenomenon, the processor 140 may calculate the target gray scale value of the current frame based on the current frame frequency of the input image.

The processor 140 may obtain the compensation value corresponding to the gray scale n of the current frame and the gray scale m of the previous frame by using the compensation value information according to a change in gray scale pre-stored in the memory 120, and obtain the target gray scale value k of the current frame by applying the predefined algorithm to the obtained compensation value according to the frequency of the current frame. The process of obtaining the target gray scale value has been described with reference to FIG. 1, and therefore the detailed description thereof will not be repeated for convenience.

Meanwhile, an amount of the gray scale compensated to obtain the target gray scale value at that time is the same as a difference |k−n| between the gray scale n and the gray scale k of the current frame, and accordingly, the value 1 of the target gray scale may be the same as a value of {n+(k−n)}=k.

After obtaining the target gray scale value of the current frame, the processor 140 may obtain a compensation value corresponding to the gray scale value m of the previous frame and the target gray scale value k of the current frame among the compensation values according to a change in gray scale pre-stored in the memory 120, and the obtained compensation value may be the same as an over-driving voltage value $V_2$ to be applied to liquid crystals according to a change from the gray scale m to the gray scale k. The over-driving voltage to be applied to the liquid crystals may be applied to the liquid crystals of the display panel 110 for a period of time corresponding to one frame of the current frame, as illustrated with a line 440 of FIG. 4.

As a result, the processor 140 may compensate the value of the gray scale n as the gray scale k in order to express the current frame having the gray scale of n, and control the timing controller 130 so that the timing controller 130 applies the over-driving voltage $V_2$ according to a change from the gray scale m of the previous frame to the compensated gray scale k of the current frame to the data driver (not illustrated) to display the current frame. At that time, the change in gray scale of the image frame displayed on the display panel 110 according to the application of the over-driving voltage $V_2$ to the data driver (not illustrated) by the timing controller 130 may be as illustrated with a line 410 of FIG. 4.

Meanwhile, FIGS. 3 and 4 illustrate only a case where the over-driving voltage is applied due to the gray scale of the previous frame higher than the gray scale of the current frame, but even when the gray scale of the current frame is lower than the gray scale of the previous frame, the under-driving voltage may be applied in the same manner as in the method described above with reference to FIGS. 3 and 4.

Figure 5:
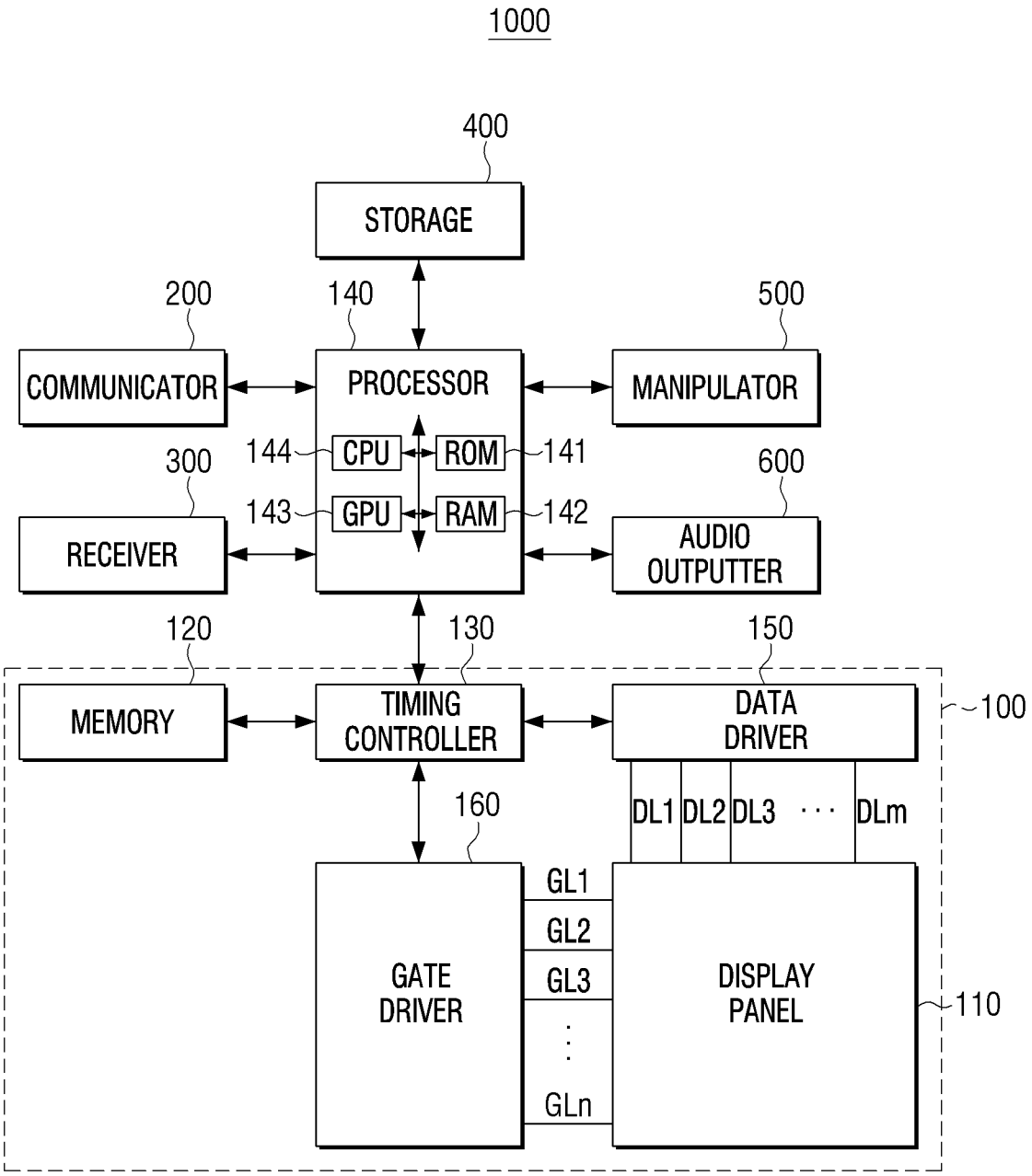
FIG. 5 is a block diagram illustrating a specific configuration of a display device according to an embodiment.

FIG. 5 is a block diagram illustrating a specific configuration of a display device according to an embodiment.

Referring to FIG. 5, the display device 1000 may include the display panel 110, the memory 120, the timing controller 130, the processor 140, a data driver 150, a gate driver 160, a communicator 200, a receiver 300, a storage 400, a manipulator 500, and an audio outputter 600.

Meanwhile, in describing FIG. 5, the display panel 110, the memory 120, and the timing controller 130 are the same as described above with reference to FIG. 1, and therefore the detailed description thereof will not be repeated.

The gate driver 160 may apply a gate-on voltage sequentially to the plurality of gate lines $GL_1$ to $GL_n$ of the display panel to turn on a thin film transistor (not illustrated) where a gate electrode is connected to the gate line to which the gate-on voltage is applied.

The data driver 150 may receive a data signal from the timing controller 130 and apply data voltage corresponding to the received data signal to a plurality of data lines $DL_1$ to $DL_m$ of the display panel.

Meanwhile, the timing controller 130 may control the gate driver 160 and the data driver 150 so that the display panel 110 displays the image frame.

The communicator 200 may communicate with an external device (not illustrated). The communicator 200 may transmit and receive various pieces of data to and from the external device (not illustrated).

In this case, the communicator 200 may communicate with the external device (not illustrated) via various types of communication methods. For example, the communicator 230 may communicate with the external device (not illustrated) according to the communication standard such as Bluetooth, Wi-Fi, or the like by using a communication module.

The receiver 300 may receive and demodulate a broadcasting signal from a broadcasting station or a satellite in a wired or wireless manner. Specifically, the receiver 300 may receive and demodulate a transmission stream via an antenna or a cable, and output a digital transmission stream signal. In this case, the receiver 300 may be implemented to include an element such as a tuner (not illustrated) or a demodulator (not illustrated). However, this is merely an embodiment, and the receiver 300 may be implemented in various forms according to implementation examples.

The storage 400 may store an image content. Specifically, the storage 400 may receive and store an image content with compressed image and sound from an audio processor (not illustrated) and a video processor (not illustrated), and may output the stored image content to the audio processor (not illustrated) and the video processor (not illustrated) under the control of the processor 140. Meanwhile, the storage 400 may be implemented as a hard disk drive, a non-volatile memory, a volatile memory, and the like.

The manipulator 500 may be implemented as a touch screen, a touch pad, a key button, a key pad, and the like to provide user manipulation of the display device 1000. In the embodiment, it is described that a control command is input via the manipulator 500 provided in the display device 1000, but the manipulator 500 may receive a user manipulation from an external control device (e.g., remote controller).

The audio outputter 600 may perform signal processing such as decoding of audio data input from the receiver 300 and the storage 400 and output the audio data. The audio outputter 600 may be implemented as a speaker and the like.

The processor 140 may control general operations of the display device 1000. For example, the processor 140 may operate an operating system or an application program to control hardware or software elements connected to the processor 140 and perform various data processing and operations. In addition, the processor 140 may load and process an instruction or data received from at least one of other elements on a volatile memory and store various pieces of data in a non-volatile memory.

For this, the processor 140 may be implemented as a dedicated processor (e.g., an embedded processor) for performing the corresponding operations or a generic-purpose processor (e.g., a CPU, a GPU, or an application processor) capable of performing the corresponding operations by executing one or more software programs stored in a memory device.

The processor 140 may transmit image data received from the external device (not illustrated) via the communicator 200 to the display panel 110 or store it in the storage 400. Specifically, the processor 140 may perform signal processing such as decoding with respect to the image data input from the receiver 300 and the storage 400 to output the image data to the timing controller 130.

The processor 140 may include a ROM 141, a RAM 142, a graphics processing unit (GPU) 143, a CPU 144, and a bus (not illustrated). The ROM 141, the RAM 142, the GPU 143, the CPU 144, and the like may be connected to each other via the bus.

The CPU 144 may execute the booting using the operating system (O/S) stored in the storage 400 by accessing the storage 400. The CPU 144 may execute various operations using various programs, contents, data, and the like stored in the storage 400. The operation of the CPU 144 is the same as the operation of the processor 140 described above, and therefore the overlapped description thereof will not be repeated.

The ROM 141 may store a set of instructions for system booting. If a turn-on instruction is input to supply power, the CPU 144 copies the O/S stored in the storage 400 to the RAM 142 and boots the system up by executing the O/S according to the instruction stored in the ROM 141. When the booting is completed, the CPU 144 copies various programs stored in the storage 400 to the RAM 142 and executes various operations by executing the programs copied to the RAM 142.

When the booting of the display device 1000 is completed, the GPU 143 may generate a screen including various objects such as an icon, an image, a text, and the like.

Meanwhile, in the example described above, the processor 140 may be included in a main board and the timing controller 130 may be included in a TCON board. However, this is merely an embodiment, when a main board and a TCON board are combined and implemented, the processor 140 and the timing controller 130 may be included in the same board.

Figure 6:
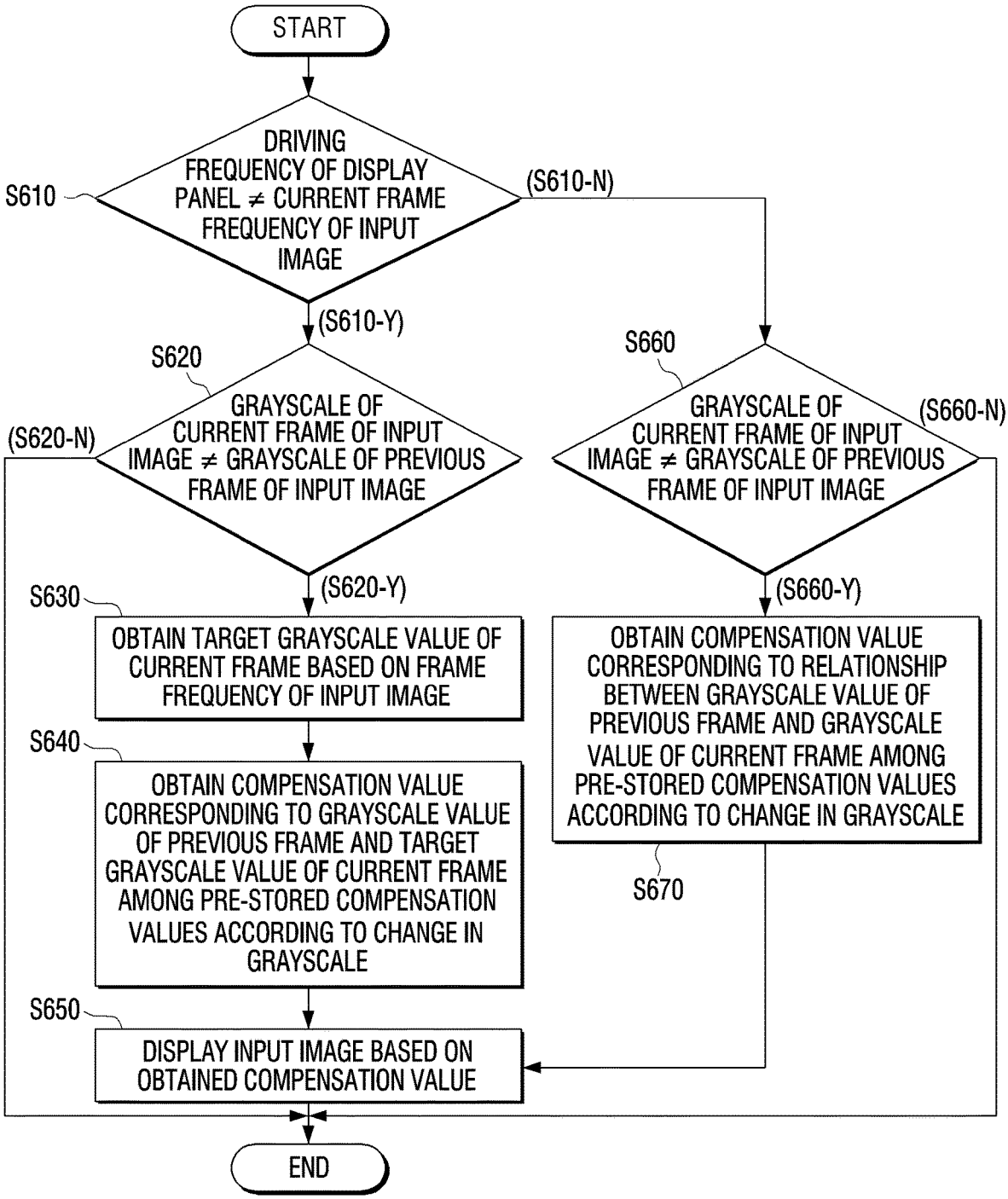
FIG. 6 is a flowchart illustrating a method for controlling a display device according to an embodiment

FIG. 6 is a flowchart illustrating a method for controlling a display device according to an embodiment.

When the driving frequency of the display panel is different from the current frame frequency of the input image (S610—Y) and the gray scale of the current frame of the input image is different from the gray scale of the previous frame of the input image (S620—Y), the display device 1000 may obtain the target gray scale value of the current frame based on the current frame frequency of the input image (S630).

At that time, the display device may obtain the compensation value corresponding to the relationship between the gray scale value of the previous frame and the gray scale value of the current frame among the pre-stored compensation values according to a change in gray scale, and obtain the target gray scale value of the current frame by applying the predefined algorithm to the obtained compensation value for each frame frequency of the input image.

Specifically, the display device may obtain the gray scale value of the current frame having the compensation value calculated by applying the predefined algorithm to the obtained compensation value as the target gray scale value of the current frame, among the plurality of gray scale values of the current frame corresponding to the gray scale values of the previous frame stored in advance.

The obtained target gray scale value of the current frame may be higher than the gray scale value of the current frame, when the frequency of the current frame of the input image is higher than the driving frequency of the display panel.

In contrast, the obtained target gray scale value of the current frame may be lower than the gray scale value of the current frame, when the frequency of the current frame of the input image is lower than the driving frequency of the display panel.

In addition, the display device 1000 may obtain the compensation value corresponding to the gray scale value of the previous frame and the target gray scale value of the current frame among the pre-stored compensation values according to a change in gray scale (S640).

Here, the pre-stored compensation values according to a change in gray scale may include preset dynamic capacitance compensation (DCC) value according to the driving frequency of the display panel.

After that, the display device 1000 may display the current frame based on the obtained compensation value (S650).

At that time, the display device may compensate the image data of the current frame based on the obtained compensation value and display the compensated image data on the display panel.

Meanwhile, when the driving frequency of the display panel is the same as the frequency of the current frame of the input image (S610—N) and the gray scale of the current frame of the input image is different from the gray scale of the previous frame of the input image (S660—Y), the display device may obtain the compensation value corresponding to the relationship between the gray scale value of the previous frame and the gray scale value of the current frame among the pre-stored compensation values (S670).

In addition, the display device may display the input image based on the obtained compensation value (S650).

Meanwhile, the specific method for controlling the display device by such a method has been described above.

The embodiments described above may be implemented in a recording medium readable by a computer or a similar device using software, hardware, or a combination thereof. According to the implementation in terms of hardware, the embodiments of the disclosure may be implemented using at least one of application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, and electronic units for executing other functions. In some cases, the embodiments described in the specification may be implemented as the processor itself. According to the implementation in terms of software, the embodiments such as procedures and functions described in this specification may be implemented as separate software modules. Each of the software modules may perform one or more functions and operations described in this specification.

Computer instructions for executing processing operations according to the embodiments of the disclosure descried above may be stored in a non-transitory computer-readable medium. When the computer instructions stored in such a non-transitory computer-readable medium are executed by the processor of a specific machine, the computer instructions may enable the specific machine to execute the processing operations on the display device according to the embodiments described above.

The non-transitory computer-readable medium is not a medium storing data for a short period of time such as a register, a cache, or a memory, but may refer to a medium that semi-permanently stores data and is readable by a machine. Specific examples of the non-transitory computer-readable medium may include a CD, a DVD, a hard disk drive, a Blu-ray disc, a USB, a memory card, and a ROM.

While preferred embodiments of the disclosure have been shown and described, the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A display device comprising:

a display panel;

a memory configured to store compensation values according to a change in a gray scale of an input image, the compensation values being preset according to a driving frequency of the display panel;

a timing controller configured to control the display panel to display a current frame of the input image based on information of the compensation values stored in the memory; and a processor configured to:

based on the driving frequency of the display panel being different from a current frame frequency of the input image and a gray scale value of the current frame of the input image being different from a gray scale value of a previous frame of the input image, obtain a first compensation value corresponding to a relationship between the gray scale value of the previous frame and the gray scale value of the current frame among the compensation values stored in the memory, and obtain a target gray scale value of the current frame by applying an algorithm predefined for each frame frequency of the input image to the obtained first compensation value, wherein the algorithm predefined for each frame frequency of the input image is based on a relationship between a compensation value according to the gray scale value of the previous frame and the gray scale value of the current frame and a compensation value stored in the memory for each frame frequency of the input image, obtain a second compensation value corresponding to the gray scale value of the previous frame and the target gray scale value of the current frame among the compensation values stored in the memory, and control the timing controller to display the current frame based on the obtained second compensation value, wherein, based on the current frame frequency of the input image being higher than the driving frequency of the display panel, the target gray scale value of the current frame is higher than the gray scale value of the current frame, and based on the current frame frequency of the input image being lower than the driving frequency of the display panel, the target gray scale value of the current frame is lower than the gray scale value of the current frame.

2. The display device according to claim 1, wherein the compensation values comprise a dynamic capacitance compensation (DCC) value preset according to the driving frequency of the display panel.

3. The display device according to claim 1, wherein the processor is further configured to obtain a gray scale value of the current frame having a compensation value calculated by applying the predefined algorithm to the obtained first compensation value, among a plurality of gray scale values of the current frame corresponding to the gray scale value of the previous frame as the target gray scale value of the current frame.

4. The display device according to claim 1, wherein the processor is further configured to:

based on the current frame frequency of the input image being a same as the driving frequency of the display panel and the gray scale value of the current frame of the input image being different from the gray scale value of the previous frame of the input image, obtain a compensation value corresponding to a relationship between the gray scale value of the previous frame and the gray scale value of the current frame among the compensation values pre-stored in the memory, and control the timing controller to display the input image based on the obtained compensation value corresponding to the relationship.

5. The display device according to claim 1, wherein the processor is further configured to compensate image data of the current frame based on the obtained second compensation value, and control the timing controller to display the compensated image data on the display panel.

6. A method for controlling a display device comprising a display panel, the method comprising:

based on a driving frequency of the display panel being different from a current frame frequency of an input image input to the display panel and a gray scale value of a current frame of the input image being different from a gray scale value of a previous frame of the input image, obtaining a first compensation value corresponding to a relationship between the gray scale value of the previous frame and the gray scale value of the current frame among compensation values according to a change in a gray scale of the input image, and obtaining a target gray scale value of the current frame by applying an algorithm predefined for each frame frequency of the input image to the obtained first compensation value, wherein the algorithm predefined for each frame frequency of the input image is based on a relationship between a compensation value according to the gray scale value of the previous frame and the gray scale value of the current frame and a compensation value stored in a memory for each frame frequency of the input image;

obtaining a second compensation value corresponding to the gray scale value of the previous frame and the target gray scale value of the current frame among the compensation values stored in the memory; and displaying the current frame based on the obtained second compensation value, wherein, based on the current frame frequency of the input image being higher than the driving frequency of the display panel, the target gray scale value of the current frame is higher than the gray scale value of the current frame, and based on the current frame frequency of the input image being lower than the driving frequency of the display panel, the target gray scale value of the current frame is lower than the gray scale value of the current frame.

7. The method according to claim 6, wherein the compensation values comprise a dynamic capacitance compensation (DCC) value preset according to the driving frequency of the display panel.

8. The method according to claim 6, wherein the obtaining the target gray scale value comprises:

obtaining a gray scale value of the current frame having a compensation value calculated by applying the predefined algorithm to the obtained first compensation value, among a plurality of gray scale values of the current frame corresponding to the gray scale value of the previous frame, as the target gray scale value of the current frame.

9. The method according to claim 6, further comprising:

based on the current frame frequency of the input image being a same as the driving frequency of the display panel and the gray scale value of the current frame of the input image being different from the gray scale value of the previous frame of the input image, obtaining a compensation value corresponding to a relationship between the gray scale value of the previous frame and the gray scale value of the current frame among the compensation values; and displaying the input image based on the obtained compensation value corresponding to the relationship.

* * * * *